US005672075A

United States Patent [19]

Maejima

[11] Patent Number: 5,672,075

[45] Date of Patent: Sep. 30, 1997

[54] ROUND TERMINAL-RECEIVING CONNECTOR

[75] Inventor: Toshiro Maejima, Shizuoka, Japan

[73] Assignee: Yazaki Corporation, Tokyo, Japan

[21] Appl. No.: 508,691

[22] Filed: Jul. 28, 1995

[30] Foreign Application Priority Data

Aug. 4, 1994 [JP] Japan ..... 6-183616

[51] Int. Cl.[6] ..... H01R 13/40

[52] U.S. Cl. ..... 439/595

[58] Field of Search ..... 439/595, 744

[56] References Cited

U.S. PATENT DOCUMENTS 4,262,987 4/1981 Gallusser et al. ..... 439/744

5,085,599 2/1992 Maejima et al. ..... 439/595

5,226,839 7/1993 Koumatsu et al. ..... 439/595

*Primary Examiner*—Neil Abrams

*Assistant Examiner*—Barry Matthew L. Standig

*Attorney, Agent, or Firm*—Sughrue, Mion, Zinn, Macpeak & Seas

[57] ABSTRACT

A socket-type terminal has an annular groove which is formed in a step portion between a base portion of a terminal connecting portion and a neck portion. A distal end of a lance head of a retaining lance for preventing withdrawal of the terminal is so formed as to fit in the groove. With this construction, when the terminal is pulled in a longitudinal direction, the whole of the retaining lance is displaced in a direction of the axis of the terminal. Therefore, the terminal is firmly retained in a housing without damaging the retaining lance.

6 Claims, 3 Drawing Sheets

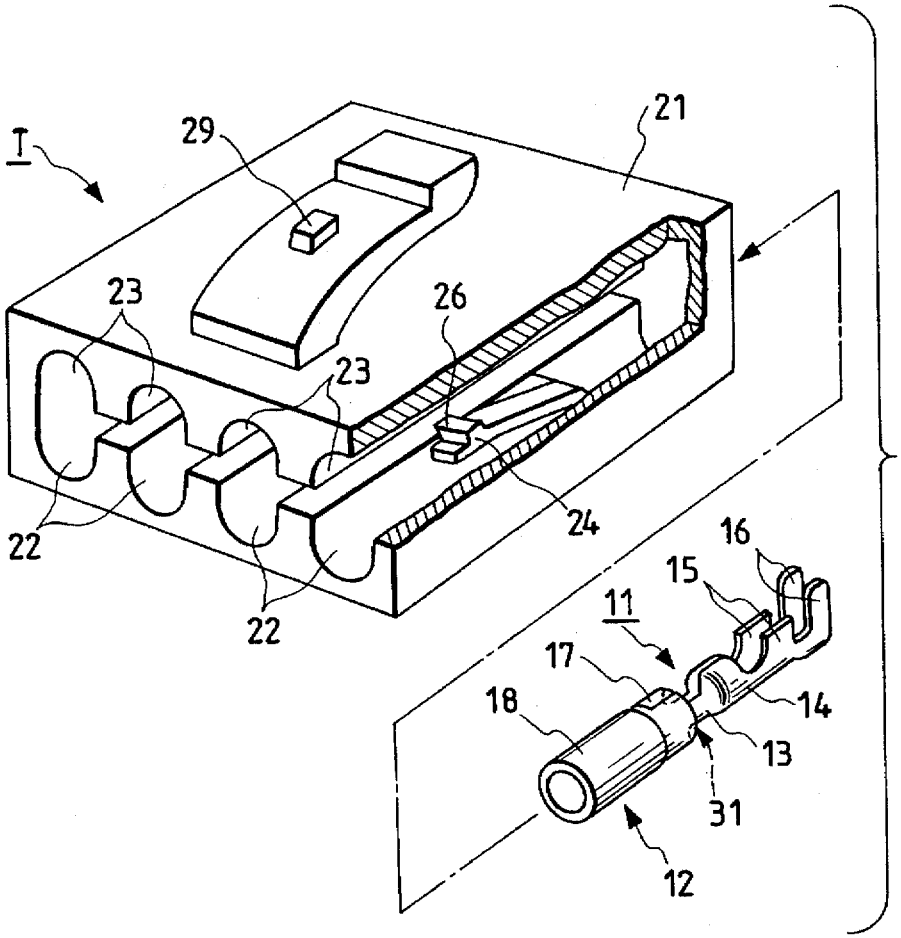
FIG. 1
FIG. 2
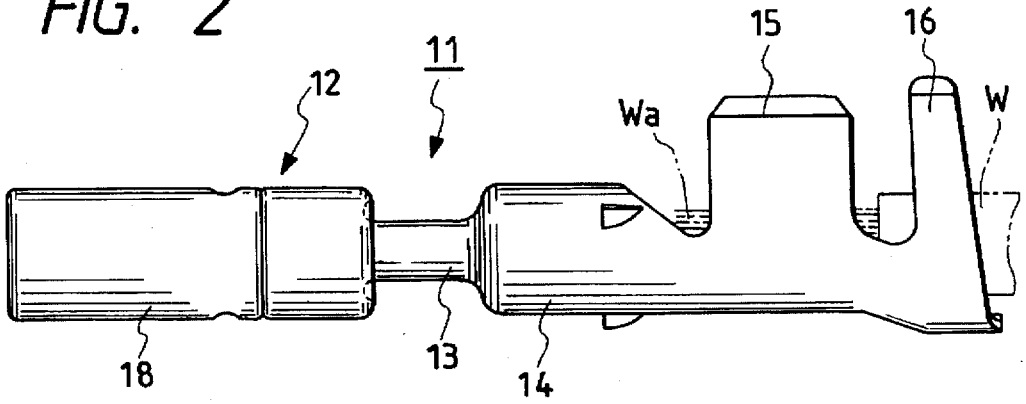

ROUND TERMINAL-RECEIVING CONNECTOR

BACKGROUND OF THE INVENTION

1. Field of the Invention

This invention relates to a construction for retaining a round terminal, having a wire clamped thereto, in a connector housing, and more particularly to a round terminal and a round terminal-receiving connector, in which the round terminal, even if pulled in a withdrawing direction, will not be easily withdrawn.

2. Background

Various kinds of connectors have heretofore been used in various kinds of electronic devices mounted on an automobile for connecting the electronic devices to wire harnesses. Particularly in a multi-pole connector having many poles, the insertion of a connecting terminal into a connector housing (hereinafter referred to merely as "housing") tends to become cumbersome. In order to enhance the efficiency of this insertion operation, there has now been an increasing demand for round terminals of a cylindrical configuration which provides a higher degree of insertion freedom.

One example of such round terminals disclosed in U.S. Pat. No. 5,085,598 will now be described with reference to FIG. 6.

As shown in FIG. 6, a socket-type female terminal 1 includes a cylindrical terminal connecting portion 2, a wire connecting portion 3 for clamping a conductor Wa of a wire W to make an electrical connection therebetween, and a wire holding portion 4 for retaining the wire W against withdrawal. The terminal connecting portion 2 is larger in diameter than the wire connecting portion 3, and a head *6a* of a retaining lance 6, formed on a housing (not shown), can be retainingly engaged with a step portion 5 provided between the two portions 2 and 3.

A mating terminal, that is, a male terminal of the pin type, is inserted into the terminal connecting portion 2 of the female terminal 1 of the above construction, so that the mating terminal can be electrically connected to the wire W. During this inserting operation, or during use of an associated electronic device, if the wire W is pulled in a direction of arrow X, the step portion 5 is retained by the head *6a* of the retaining lance 6, thereby preventing withdrawal of the terminal.

In the female terminal 1 of the above construction, however, when the wire W is pulled hard in the direction of arrow X, an edge *2a* of the terminal connecting portion 2 strikes hard against the head *6a*, so that the head *6a* may be damaged. If such a situation occurs, the whole of the female terminal 1 can be easily withdrawn from the housing, and in some cases when trying to connect the mating terminal to the terminal connecting portion 2, the female terminal 1 is displaced, so that the proper connection can not be achieved.

To overcome the above problem, a female terminal 10 shown in FIG. 7 is usually used. More specifically, in the female terminal 10, no corner is formed over a surface extending from a step portion 5, provided at a rear end of a terminal connecting portion 2, to a neck portion 3. Rather a head *6b* of a retaining lance 6 has a configuration corresponding to the shape of a curved surface of the step portion 5.

In this construction, no corner is formed on either of the step portion 5 and the retaining lance 6, and therefore even if the female terminal 10 is pulled hard in a direction of arrow X, the head of the lance will not be damaged.

However, when the female terminal 10 is pulled harder in the direction of arrow X, the retaining lance is elastically deformed to be displaced in a direction of arrow Y, so that a retaining force is lowered.

SUMMARY OF THE INVENTION

This invention has been made to overcome the above problems, and an object of the invention is to provide a round terminal-receiving connector in which a round terminal, inserted into a housing, is held firmly, and a high reliability is achieved.

The above object of the invention has been achieved by a round terminal-receiving connector comprising a round terminal which has a wire connected to one end thereof, and is adapted to be connected at the other end thereof to a mating terminal; and a connector housing which includes a terminal insertion hole for inserting the round terminal thereinto, and a retaining lance formed in the terminal insertion hole for retaining the round terminal. The round terminal includes a groove which is formed between a terminal connecting portion of a larger diameter and a neck portion of a smaller diameter which constitute the round terminal; and the retaining lance has at its distal end a lance head which is fitted in the groove in a normal condition, and causes the retaining lance to be displaced in a direction of an axis of the round terminal when the round terminal is urged in a direction of a length of the round terminal.

The above object can be achieved by a construction in which the groove is annular, and is formed in a peripheral wall formed between the terminal connecting portion and the neck portion.

The above object can be achieved by a construction in which a distal end of the lance head projects forwardly at an acute angle so as to fit in the groove.

In the round terminal-receiving connector of the above construction, the round terminal has the groove which is formed between the terminal connecting portion of a larger diameter and the neck portion of a smaller diameter, and the retaining lance has at its distal end the lance head which is fitted in the groove in the normal condition, and causes the retaining lance to be displaced in the direction of the axis of the round terminal when the round terminal is urged in the direction of the length of the round terminal.

With this construction, in the normal condition of the round terminal, the head of the retaining lance is fitted in the groove, thereby preventing withdrawal of the round terminal. When the round terminal is pulled in a withdrawing direction, the round terminal is displaced with the outer peripheral portion of the groove brought into a position beneath the head, so that the whole of the retaining lance is displaced in the direction of the axis of the round terminal, thereby retaining the round terminal more firmly.

BRIEF DESCRIPTION OF THE DRAWINGS

FIG. 1 is a perspective view of a preferred embodiment of a round terminal-receiving connector of the present invention;

FIG. 2 is a side view of a socket-type round terminal used in this embodiment;

DETAILED DESCRIPTION OF THE PREFERRED EMBODIMENTS

Figure 3:
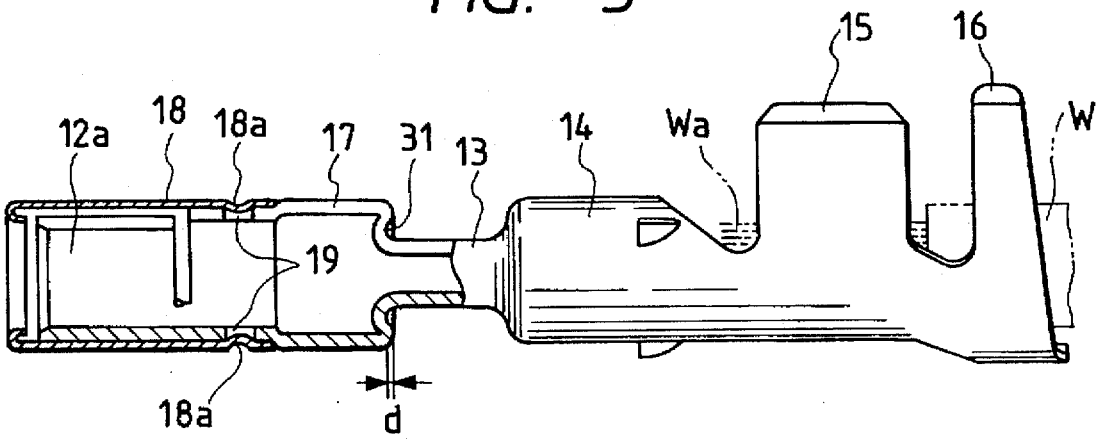
FIG. 3 is view similar to FIG. 2, but is a partly cross-sectional view.

First preferred embodiment of a round terminal-receiving connector of the invention will now be described in detail with reference to FIGS. 1 to 4. FIG. 1 is an exploded, perspective view of the round terminal-receiving connector of the invention, FIG. 2 is a side view of a socket-type round terminal used in the connector of FIG. 1, FIG. 3 is a partly cross-sectional view, showing a terminal connecting portion, and FIG. 4 is an enlarged, cross-sectional view of an important portion of the round terminal retained within a housing by a retaining lance.

As shown in FIG. 1, the connector T comprises a housing 21 of an integral construction molded of a resin, and socket-type female terminals 11 inserted into the housing 21. The female terminal 11 includes a terminal connecting portion 12 of a cylindrical shape, a cylindrical neck portion 13 of a smaller diameter, and a wire connecting portion 14 which is generally equal in diameter to a base portion 17 of the terminal connecting portion 12, and comprises a pair of wire holding portions 15 and 16.

The housing 21 has two (upper and lower) rows of terminal insertion holes 22 and 23 each receiving the female terminal 11, a mating terminal being adapted to be inserted into the terminal insertion hole 22, 23 to be connected to the associated female terminal. Retaining lances 24 are formed on the housing 21, and each retaining lance 24 is disposed between the corresponding pair of terminal insertion holes 22 and 23. A retaining member 29 for retaining a mating housing (not shown) is formed on an outer surface of the housing 21.

Figure 4:
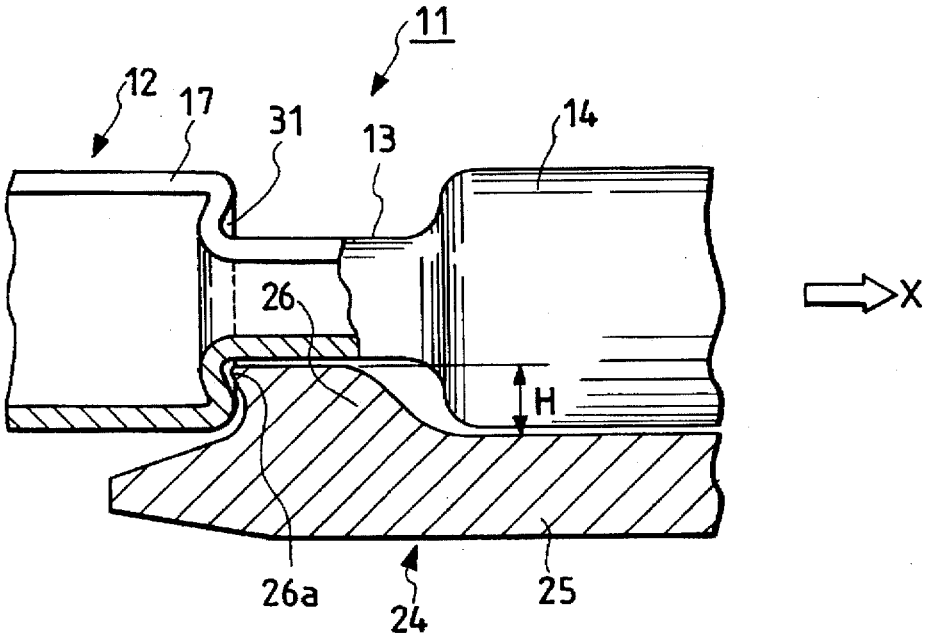
FIG. 4 is an enlarged cross-sectional view of an important portion of the round terminal retained by a retaining lance in this embodiment.

As shown in FIGS. 2 and 3, the socket-type female terminal 11 is formed by punching a single metal sheet and then by forming this punched metal sheet into a cylindrical configuration. A distal end portion of the terminal connecting portion 12 defines a smaller-diameter portion 12*a*, and a sleeve 18 is fitted on this smaller-diameter portion 12*a*. Retaining holes 19 are formed through the smaller-diameter portion 12*a*, and projections 18*a* formed on the sleeve 18 are engaged respectively in the retaining holes 19 to retain the sleeve 18 against disengagement from the smaller-diameter portion 12*a*.

The female terminal 11 has the neck portion 13 provided between the base portion 17 of the terminal connecting portion 12 and the wire connecting portion 14. An annular groove 31 with a depth d is formed in a step portion between the neck portion 13 and the base portion 17. This groove 31 is formed by pressing in the process of shaping the punched metal sheet into a cylindrical configuration to form the female terminal 11.

As shown in FIG. 4, the retaining lance 24 includes an elastic, tongue-like lance base portion 25, and a lance head 26 formed on the lance base portion 25, the lance head 26 having a height H corresponding to the step between the base portion 17 of the terminal connecting portion 12 and the neck portion 13. The lance head 26 has a distal end 26*a* formed into a convex shape corresponding to a curved surface of the groove 31. When the female terminal 11 is inserted into the terminal insertion hole 22, 23, the lance head 26 is received in the neck portion 13, with its distal end 26*a* fitted in the groove 31. As a result, even if the female terminal is pulled hard in a direction ,of arrow X, it will not be easily withdrawn.

Namely, in the construction of this embodiment, the lance head 26 and hence the whole of the retaining lance 24 are urged in the direction of the axis of the female terminal 11 by the outer peripheral portion of the groove 31. Therefore, the force to retain the female terminal 11 is further enhanced.

And besides, a corner portion of the terminal connecting portion 12 never strikes hard against the lance head 26 of the retaining lance 24, and therefore damage to the retaining lance 24 by the female terminal 11 is positively avoided.

Thus, in the connector T of this embodiment, the withdrawal of the female terminal 11, as well as damage to the retaining lance 24, is positively prevented, and therefore the reliability of the connector T is enhanced, so that the reliability of various electronic devices using the connector T is also enhanced.

Figure 5:
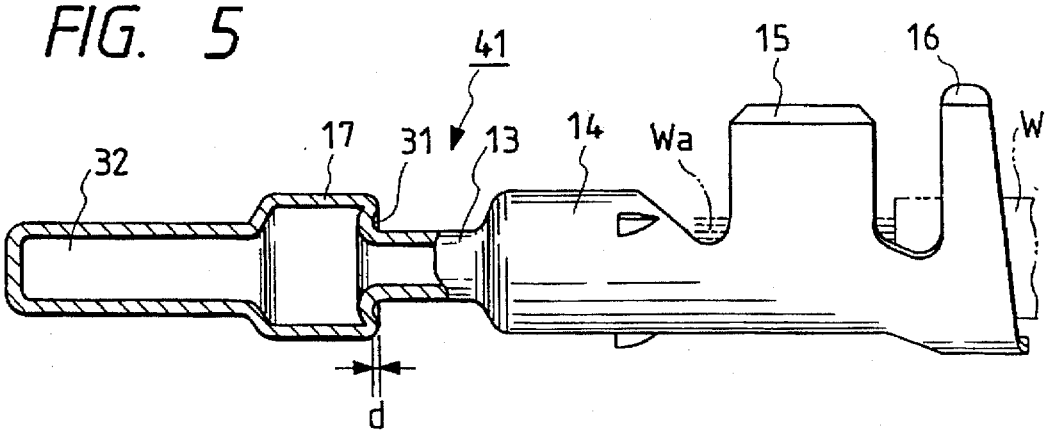
FIG. 5 is a partly cross-sectional view of a preferred embodiment of a pin-type round terminal.
Figure 6:
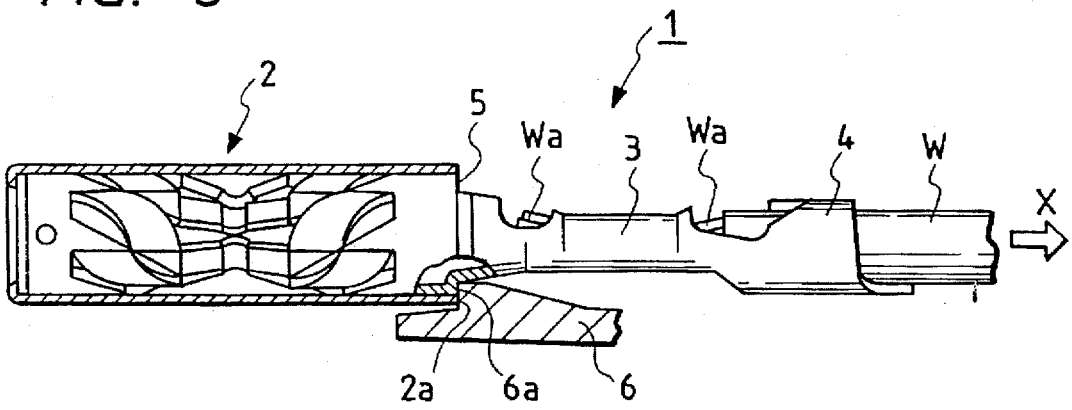
FIG. 6 PRIOR ART
FIG. 6 is a partly cross-sectional view of a conventional round terminal.
Figure 7:
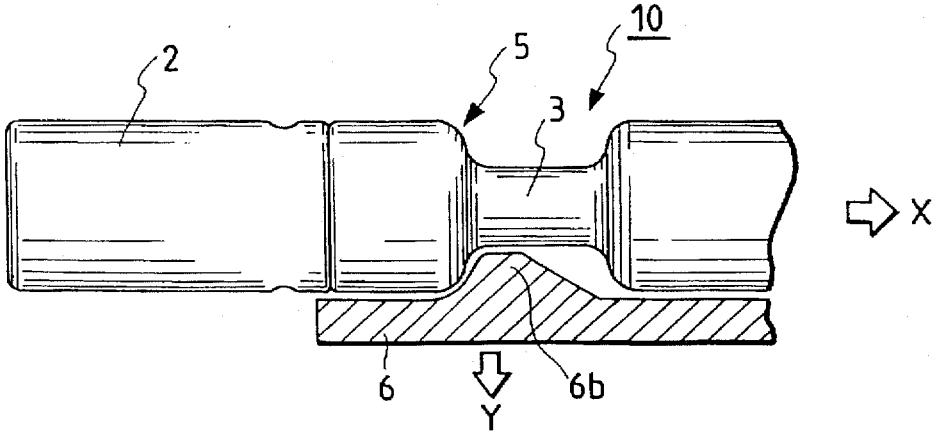
FIG. 7 PRIOR ART
FIG. 7 is a view of a portion of another conventional round terminal.

Next, second preferred embodiment of the present invention, in which the invention is applied to a pin-type round terminal, will now be described with reference to FIG. 5. This male terminal 41 is fitted in and connected to the above-mentioned female terminal 11. The male terminal 41 has a terminal connecting portion 32 of a cylindrical shape defined by its front end portion. Like the female terminal 11, the male terminal 41 has a neck portion 13 provided between a base portion 17 of the terminal connecting portion 32 and a wire connecting portion 14. An annular groove 31 with a depth d is formed in a step or shoulder portion between the base portion 17 and the neck portion 13. This groove 31 functions to retain the male terminal in a housing with the aid of a retaining lance having the same construction as that shown in FIG. 4.

As described above, in the round terminal-receiving connector of the present invention, the round terminal has the groove which is formed between the terminal connector portion of a larger diameter and the neck portion of a smaller diameter, and the retaining lance has at its distal end the lance head which is fitted in the groove in the normal condition, and causes the retaining lance to be displaced in the direction of the axis of the round terminal when the round terminal is urged in the direction of the length of the round terminal.

With this construction, when the round terminal is pulled in the withdrawing direction, the retaining lance is displaced in the direction of the axis of the round terminal to increase the retaining force, thereby retaining the round terminal more firmly. Therefore, the reliability of the connector having the round terminals inserted therein is further enhanced.

What is claimed is:

1. A connector, comprising:

a connector housing;

a terminal insertion hole formed in said connector housing;

a retaining member disposed in said terminal insertion hole;

a terminal including a wire connecting portion for clamping a wire thereto and a terminal connecting portion for mating with another terminal, said terminal being received into said terminal insertion hole;

a neck portion formed between said wire connecting portion and said terminal connecting portion;

a step portion defined by a wall traversing the difference in diameter between said terminal connecting portion and said neck portion;

a cavity formed along said wall; and an extruding portion formed at a distal end of said retaining member and shaped so as to closely fit into said cavity, wherein said extruding portion retains said terminal inside said insertion hole, and wherein when a pulling force in a withdrawing direction is exerted on said terminal, said extruding portion enters said cavity to be locked therewith.

2. The connector of claim 1, wherein said terminal is substantially formed into a cylindrical shape.

3. The connector of claim 2, wherein said cavity is formed into an annulation.

4. The connector of claim 1, wherein said cavity has a planted side wall.

5. The connector of claim 1, wherein said extruding portion projects forwardly at an acute angle so as to be urged toward a longitudinal axis of said terminal when said pulling force is applied to said terminal.

6. The connector of claim 1, wherein a diameter of said neck portion is smaller than a diameter of said terminal connecting portion.

* * * * *